US007219443B2

(12) United States Patent
Czaplewski et al.

(10) Patent No.: US 7,219,443 B2
(45) Date of Patent: May 22, 2007

(54) PROTECTIVE BOOTIES AND LEGGINGS

(76) Inventors: Eric Czaplewski, 6816 Aaron Dr., Ft. Collins, CO (US) 80524-8713; Andrew R. Czaplewski, 6816 Aaron Dr., Ft. Collins, CO (US) 80524-8713

( * ) Notice: Subject to any disclaimer, the term of this patent is extended or adjusted under 35 U.S.C. 154(b) by 132 days.

(21) Appl. No.: 11/007,751

(22) Filed: Dec. 7, 2004

(65) Prior Publication Data

US 2006/0117598 A1 Jun. 8, 2006

(51) Int. Cl.
*A43B 1/10* (2006.01)

(52) U.S. Cl. ..... 36/7.3; 36/2 R

(58) Field of Classification Search ..... 36/7.1 R, 36/7.3, 4, 2 R
See application file for complete search history.

(56) References Cited

U.S. PATENT DOCUMENTS

| | | | | |
|---|---|---|---|---|
| 26,436 | A | 12/1859 | Keffer | |
| 126,450 | A | 5/1872 | Drown | |
| 311,123 | A | 1/1885 | Hall | |
| 377,822 | A | 2/1888 | Zimmermann | |
| 988,159 | A | 3/1911 | Wiltse | |
| 1,009,772 | A | 11/1911 | Merrick | |
| 1,258,024 | A | 3/1918 | Laybourn | |
| 1,655,652 | A * | 1/1928 | Kemper | 36/4 |
| 1,704,688 | A * | 3/1929 | Valentine et al. | 36/7.3 |
| 1,748,607 | A | 2/1930 | Jarrett | |
| 1,765,371 | A * | 6/1930 | Grau | 36/2 R |
| 1,884,284 | A | 10/1932 | Schneider | |
| 2,034,091 | A * | 3/1936 | Dunbar | 36/4 |
| 2,210,475 | A | 8/1940 | Trimble | |
| 2,276,582 | A | 3/1942 | Krevis | |
| 2,305,926 | A | 12/1942 | Kohler | |
| 2,376,399 | A | 5/1945 | Yandell | |
| 2,493,878 | A | 1/1950 | Kirtz | |
| 2,724,195 | A | 11/1955 | Luchs | |
| 2,973,589 | A | 3/1961 | Rigsby | |
| 3,648,109 | A | 3/1972 | Tims et al. | |
| 3,713,232 | A | 1/1973 | Bohmann | |
| 3,921,313 | A | 11/1975 | Mahide et al. | |
| 4,150,498 | A | 4/1979 | Palmer | |
| 4,151,662 | A * | 5/1979 | Vistins | 36/98 |
| 4,176,475 | A | 12/1979 | Arcamonte | |
| 4,194,308 | A | 3/1980 | Karlsson | |
| 4,512,089 | A * | 4/1985 | Carrier | 36/112 |
| 4,825,586 | A | 5/1989 | Coppedge | |
| 4,845,862 | A | 7/1989 | Phillips, Jr. et al. | |
| 4,856,208 | A | 8/1989 | Zaccaro | |
| 5,604,997 | A | 2/1997 | Dieter | |
| 5,740,559 | A | 4/1998 | Thiel | |
| 5,970,525 | A | 10/1999 | Gallinot et al. | |
| 6,280,479 | B1 | 8/2001 | Phillips | |
| 6,477,788 | B1 * | 11/2002 | Chen | 36/1.5 |
| 6,519,877 | B2 | 2/2003 | Oetting et al. | |

* cited by examiner

*Primary Examiner*—Ted Kavanaugh
(74) *Attorney, Agent, or Firm*—James K. Poole, Esq.

(57) ABSTRACT

Protective footgear are provided which are fabricated of stiff but flexible fabrics such as canvas with the sole and at least lower portions at least partially impregnated with a rubbery waterproof material. The footgear or "booties" are designed to be worn over work shoes or boots to protect them from dirty environments or to permit the wearer to enter "clean" areas without removing dirty boots. Optional leggings, extending as high as the knee, can be provided as a removable or permanent part of the footgear. Patterns, materials and instructions can be assembled and provided as a kit for fabrication of personal footgear.

14 Claims, 11 Drawing Sheets

PROTECTIVE BOOTIES AND LEGGINGS

BACKGROUND OF THE INVENTION

1. Field of the Invention

The present invention pertains to protective footgear and garments to protect the feet and legs during and after dirty work, particularly to protective booties with waterproof soles and easily-donned uppers or leggings of variable lengths. Such items can also be donned after dirty work when it is necessary to enter a cleaner area.

2. Discussion of Relevant Art

In many service occupations such as cable TV installation, the practitioners must work in both indoor and outdoor environments or in other situations where at least one environment is dirty and at least one other is clean. Dirty environments could be considered residential yards, barnyards or other areas where mud, moisture or debris are found, mechanical shops where the floors are dirty, greasy and contain metal shavings and similar debris, or areas of manufacturing or medical facilities which are not "clean" or sterile by the standards imposed by the respective industries. "Clean" environments include residential areas of homes, areas of medical facilities such as operating rooms or special wards where sterile conditions must be maintained, and areas of manufacturing facilities dealing with pharmaceuticals, semiconductor devices or the like where foreign particles must be minimized. Although various types of footgear have been manufactured to protect the feet for centuries, even millennia, the manufacture and use of specific types of footgear to prevent the transfer of contaminants from one environment to another is a relatively recent development. One example in the residential context is the Japanese custom of leaving the everyday shoes worn outdoors at the entrances of homes, restaurants, shrines and temples.

Large numbers of patents dating from the 19th Century to recent years disclose a wide variety of footgear filling various fashion and protective objectives.

For example, U.S. Pat. No. 4,194,308 discloses a pattern for a "boot blank" which can have a leg portion attached when assembled. The material is rubbery, preferably faced on both sides with fabric. The boot with legs can be used for wading. At the top of column 6 (illustrated in FIG. 6), the boots are dipped in a polymeric material such as a latex solution, then vulcanized to provide greater water repellency and insulation.

U.S. Pat. No. 126,450 discloses a one-piece pattern for forming what is entitled an "improvement in shoes," but is described as a "combined in-sole sock and slipper". It is designed to be worn inside work boots as a spacer, and the insole can be waterproof. An elastic strap (I) is provided as a closure.

U.S. Pat. No. 4,194,308 discloses a pattern for a "boot blank" which can have a leg portion attached when assembled. The material is rubbery, preferably faced on both sides with fabric. The boot with legs can be used for wading. At the top of column 6 (illustrated in FIG. 6), the boots are dipped in a polymeric material such as a latex solution, then vulcanized to provide greater water repellency and insulation.

U.S. Pat. No. 3,713,232 discloses foldable, lace-up overboots fabricated of thin flexible "rubber fabric," with a rubber outer sole.

U.S. Pat. No. 1,258,024 discloses slip-on cloth overshoes formed from a one-piece pattern, designed to protect leather shoes from wear and keep the feet warmer.

U.S. Pat. No. 311,123 discloses a "cloth boot" with a medium leg, formed from a one-piece pattern of fabric, which can be waterproofed. The material suggests that the "boot" is actually intended for wear inside a larger boot.

U.S. Pat. No. 3,648,109 discloses conventional "sanitary shoe covers" or booties, which can be made from materials ranging from paper and fabrics to plastics. The bootie is retained on the foot by an elastic top, and a conducting tape is provided to prevent the buildup of static electricity.

U.S. Pat. No. 2,973,589 discloses an "adjustable baby shoe" which is formed from a single piece of soft leather, fabric or plastic and is retained in place by laces encircling the ankle.

U.S. Pat. No. 1,748,607 discloses an "emergency protective covering" for booted feet, formed of a single sheet of insulating material which can be protected on one side by paper, fabric or the like, treated or untreated. The covering is formed over the boot and retains its shape due to "pliable nonresilient means such as wire fabric."

U.S. Pat. No. 1,009,772 discloses a "foot covering" formed from a one-piece pattern. Resembling slippers, these items are made from paper, fabric or other disposable material, for use by medical personnel. The top toe portions of the slipper overlap and are secured in place to fasten the shoe.

U.S. Pat. No. 988,159 discloses a "dust moccasin" formed from a one-piece pattern of flexible material and intended to be worn over children's shoes when they enter carriages or cars from outside. Clasps are provided to hold the item together and on the child's shoes.

U.S. Pat. No. 2,305,926 discloses a "protective foot covering" which is lightweight, foldable and washable, being formed of materials such as oil silk, wax-treated paper or "cellophane", preferably waterproof. The items are slipped onto the foot and fastened with an ankle lace.

U.S. Pat. No. 2,276,582 discloses "sanitary paper slippers" formed from a complicated one-piece pattern, having ventilation perforations and preferably made from waterproofed paper.

The following patents pertain to "boots".

U.S. Pat. No. 3,921,313 discloses injection molded boots comprising a stretchable cloth base, a synthetic resin layer containing decorative patterns, and a transparent resin layer molded over the first layer.

U.S. Pat. No. 26,436 (1859) discloses an improved boot upper which is formed from a single-piece pattern which is stitched together.

U.S. Pat. No. 6,519,877 discloses a snowboard boot with thick uppers and sole, having a removable upper support fitting within the uppers.

U.S. Pat. No. 4,845,862 discloses cold weather footwear comprising a boot which contains an inner preformed sock and an insole assembly.

The following patents pertain to "shoes".

U.S. Pat. No. 2,210,475 discloses a "foot covering" which is formed from a one-piece pattern into a light, backless slipper which can be worn over hosiery and within an outer shoe.

U.S. Pat. No. 4,176,475 discloses a slipper assembled from a single-piece pattern to provide a fleece-like surface both inside and out.

U.S. Pat. No. 5,604,997 (to Nike) discloses shoe uppers, a one-piece pattern and method of assembling same into low-cut shoe uppers. The material can be cloth, synthetic leather or leather, which can be imprinted and/or compression-molded with elastic or rubbery materials.

U.S. Pat. No. 4,856,208 discloses athletic shoes with soles which have an air cushion component.

U.S. Pat. No. 377,822 discloses a shoe or slipper formed from a one-piece pattern of suitable material and containing a plate to stiffen the inner sole.

The following patents pertain to leg coverings or leggings:

U.S. Pat. No. 1,884,284 discloses a foldable "protective garment" for covering the legs and feet when seated in a stadium or the like, formed of paper, fabric or waterproof materials.

U.S. Pat. No. 2,493,878 discloses a "hosiery guard" formed of a one-piece pattern of transparent, waterproof material, designed to cover a lady's leg and hosiery from foot to the knee. The guard or legging is closed by folding over two halves and snapping them together with mechanical snaps along the front or shin portion.

U.S. Pat. No. 5,740,559 discloses a "footwear accessory" which can be formed of various suitable materials and slips into a shoe over socks or hosiery, then covers a portion of the leg to create the appearance of a boot. The "stocking-like structure" can be fastened along the front with zippers, buttons or other closures.

U.S. Pat. No. 5,970,525 discloses a "leg guard" to cover the legs and upper foot for protection while doing yard work, etc. The guards can be made of canvas, foam or sheet rubber or the like and fasten behind the leg and underfoot with a number of straps.

The following patents pertain to "slippers":

U.S. Pat. No. 2,376,399 discloses foot coverings formed from a one-piece pattern for a slipper-like covering to be worn inside ladies' shoes. The material can be knit or woven fabrics such as used for hosiery.

U.S. Pat. No. 2,724,195 discloses a similar foot protector to be worn inside ladies' shoes, formed of a unitary piece of fabric and having elastic material around the foot opening.

U.S. Pat. No. 4,150,498 discloses a foot cover (or sock substitute) formed from a substantially Y-shaped one-piece blank of stretchable material. It serves a similar function as the two devices discussed above—wear inside ladies' shoes.

The last two patents pertain to prostheses and braces:

U.S. Pat. No. 6,280,479 discloses a foot prosthesis having a cushioned ankle and a molded, hollow foot portion.

U.S. Pat. No. 4,825,856 discloses a reinforced ankle and foot brace designed to fit inside a boot or high shoe. The support panels are formed from a plastic mesh designed to conform to the ankle.

Despite the many patents in the area of footgear and protective clothing, Applicants have found no single design which is potentially as useful or convenient for a person who works daily in both "clean" and "dirty" areas, with frequent passage between such areas, as their invention disclosed and claimed below.

SUMMARY OF THE INVENTION

It is an object of the present invention to provide footgear which are effective in protecting the feet and at least a portion of the wearer's legs from dirt, moisture, oil, grease or the like, or alternatively protecting a clean floor surface and/or furniture from the wearer's dirty shoes or boots. It is a further object that at least the sole portion of such footgear be waterproof. Another object is that the footgear include upper portions to protect a portion of the legs (or the wearer's surroundings), optionally extending at least to the wearer's knees, and be easily donned, secured in place for use, or removed. The ability to readily put on and remove the footgear is an object because the user will not wish to spend more than the minimum time required for such changes while working, and convenience tends to encourage consistent use of the protective gear where appropriate. Certain of these objects are attained by the various embodiments of the invention disclosed and claimed below.

In accordance with the present invention, protective footgear are provided which have uppers of various lengths, ranging from those of typical work boots to leggings reaching to at least the user's knees. The footgear take the shape of protective overshoes or boots, and are informally referred to as "booties" for convenience in some of the text below. The footgear are fabricated of fabrics or other porous sheet goods to provide ample ventilation for the user's feet, and are at least partially impregnated in the sole and adjacent areas with a rubbery material which dries into a flexible, waterproof layer protecting the foot from moisture and preventing leakage from either direction. The finished rubbery coating is preferably resistant to oils, solvents, acids, alkalies and household or industrial cleaners. The footgear preferably include elastic tensioning means in the ankle area to secure them firmly to the user's feet and permit one size to fit a variety of feet.

The footgear and uppers or leggings can be fabricated in any suitable manner by folding and sewing cut pattern components of sheet goods, but are preferably formed from a one-piece cut pattern. Various expedients can be employed to conserve the sheet material used in the production, however. Where higher uppers or leggings are provided, these portions can be an integral part of the pattern, or can be separate components which are attached either permanently or removably (by suitable mechanical fasteners) to the footgear. In this manner, the user can employ the leggings only when actually required by the job. Mechanical closures are provided for the footgear, including uppers and leggings when employed, which are quickly and easily fastened and unfastened. A number of suitable closure devices known in the art can be employed, but the present preference is for hook-and-loop fabric combinations such as Velcro (™) The booties, with or without leggings, can be manufactured for sale in a variety of suitable sizes or also sold in kit form including patterns and all needed materials. Patterns in various sizes and instructions for fabricating the booties and leggings from suitable materials can also be produced for sale under the claims below.

BRIEF DESCRIPTION OF THE DRAWINGS

The objects and advantages of the present invention will be further understood by perusal of the following detailed description, the appended claims, and the drawings, in which:

DETAILED DESCRIPTION OF PREFERRED EMBODIMENTS

Firstly, the components of the embodiments of the invention disclosed and illustrated herein may be described as having upper and lower surfaces or first and second surfaces, using a terrestrial frame of reference where "top" or "upper" surfaces are opposite the surface of the earth from which the force of gravity attracts objects. Where used, the expression "and/or" is used in the sense of A, B or A+B. The term is a shorthand form used to mean that either A or B or both can be present. In the various figures, some components of the invention may be omitted or unlabeled for clarity.

Figure 1:
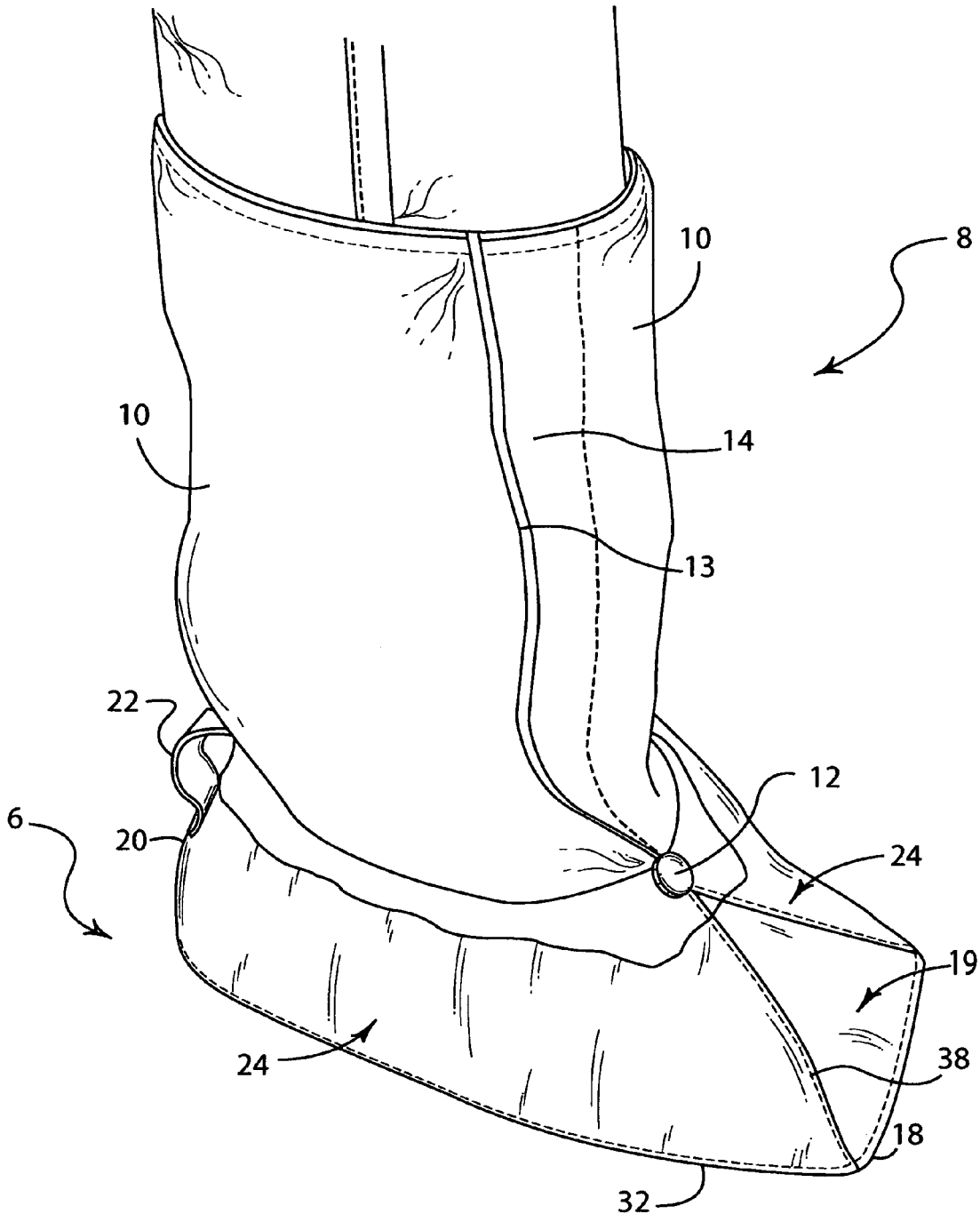
FIG. 1 is a side perspective view of the "bootie" of the invention.

Turning now to the drawings, FIG. 1 shows a bootie 8 with a relatively short upper or legging 10 and a foot comprising toe 18, heel 20, sole 32 and finger loop 22 which are parts of the foot portion of the bootie. At least the sole and lower portion of the bootie are covered or at least partially impregnated with a rubbery coating 24, discussed further below. Edge portions of the cut pattern material 8A are fastened together along seams 38 to form the toe 18 and toe flap 19, and a mechanical fastener 12 such as a rivet is preferably used to secure the upper front portions of the bootie together. Legging 10 is sewn or other fastened together at the rear (not shown here) and is closed to form an overlapping front closure 13, using suitable closure means 14.

Figure 2:
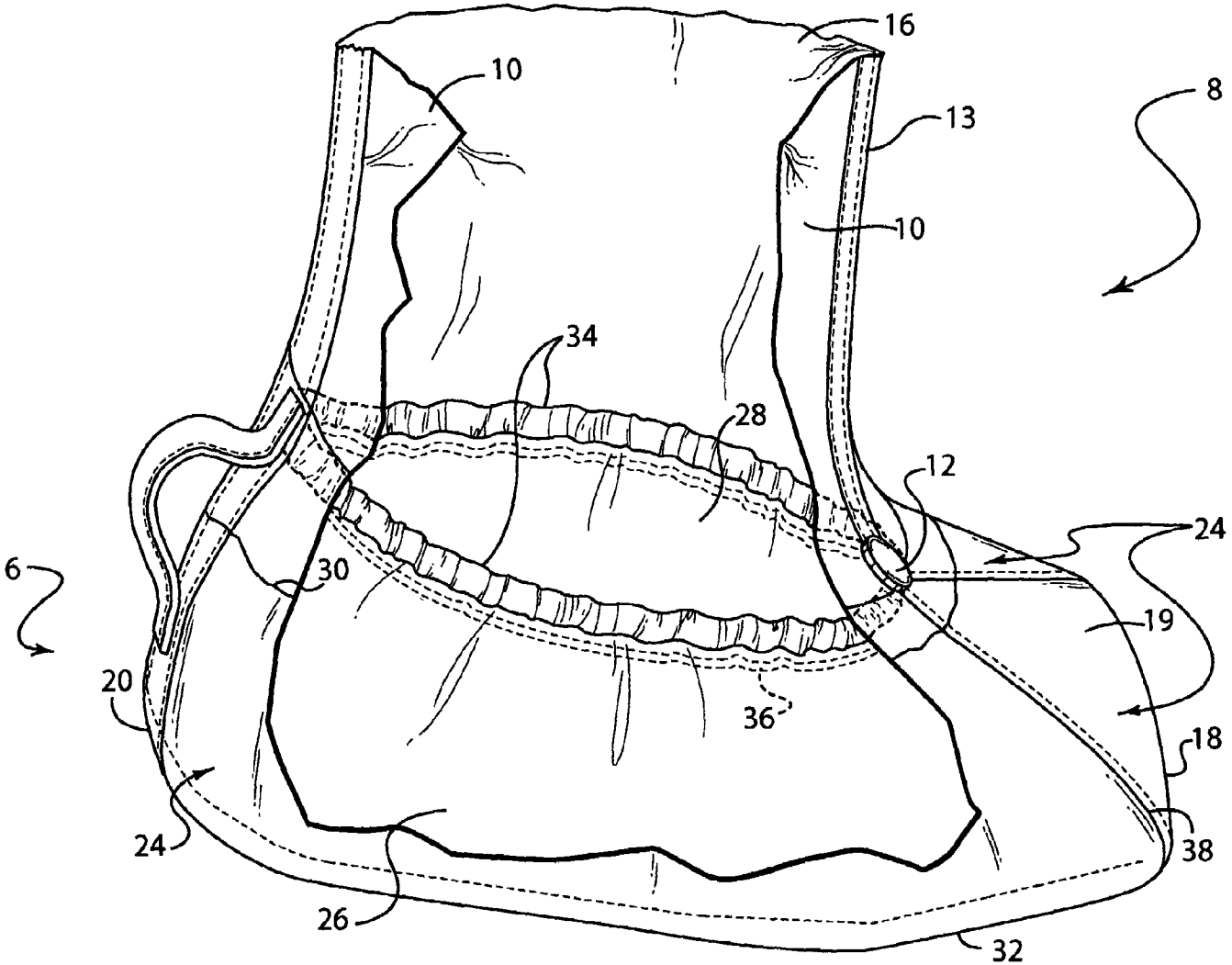
FIG. 2 is a side perspective view of the bootie of FIG. 1, cut away to show inner structure.

FIG. 2 illustrates the inner structure of the bootie 8 of FIG. 1. Inner bootie 26 is made of canvas or other foot-friendly material such as other fabrics, natural or synthetic leathers or the like, and secured to the foot structure by seams or other suitable fastening means 36. Preferably, an ankle tensioning device such as elastic 34 is included in the border between the foot portion 6 and upper or legging 10. The inner surface of inner legging 16 is visible, as well as inner surface 28 of inner bootie 26.

Figure 3:
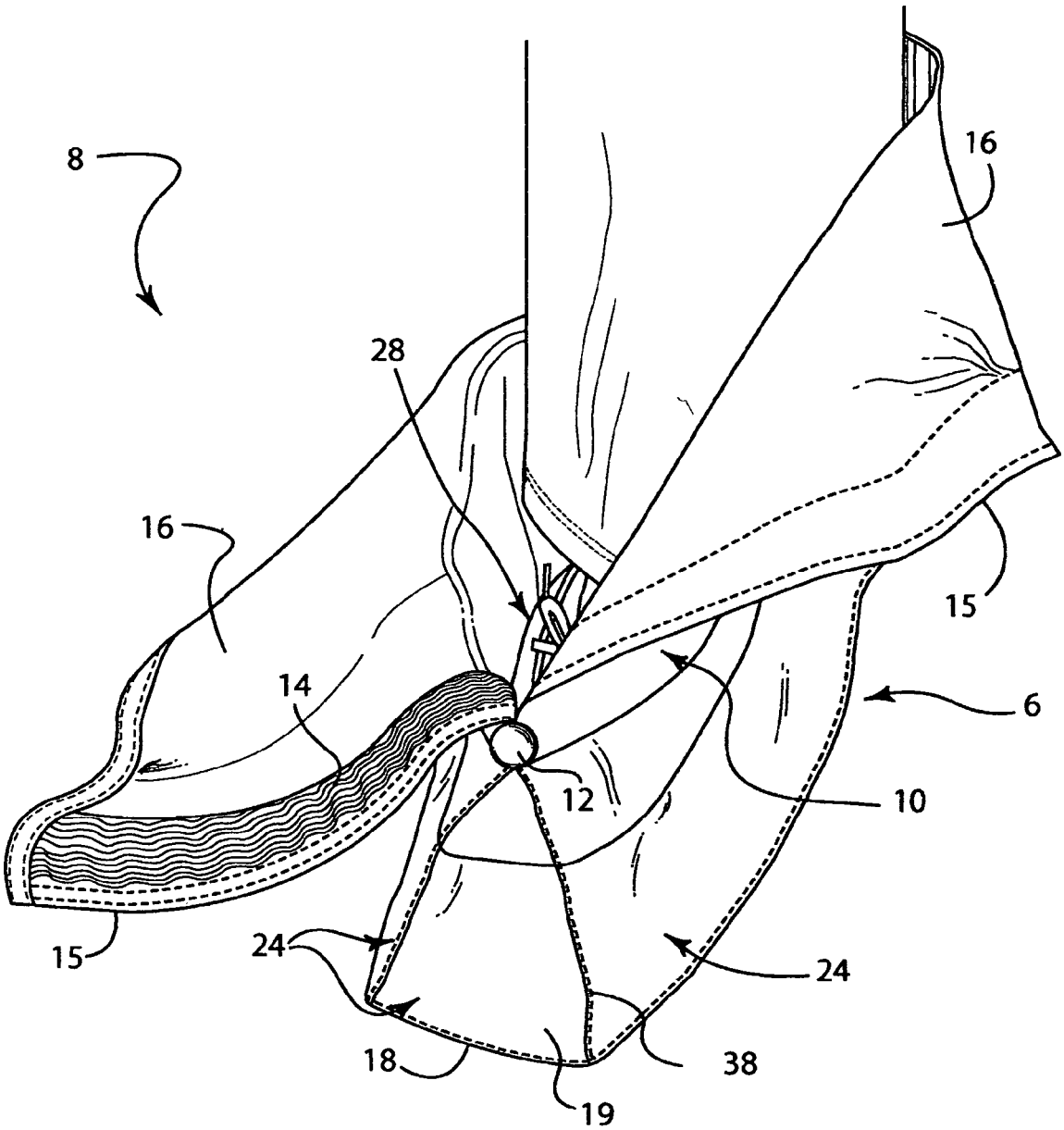
FIG. 3 is a front perspective view of the bootie illustrating the open upper portion.
Figure 6:
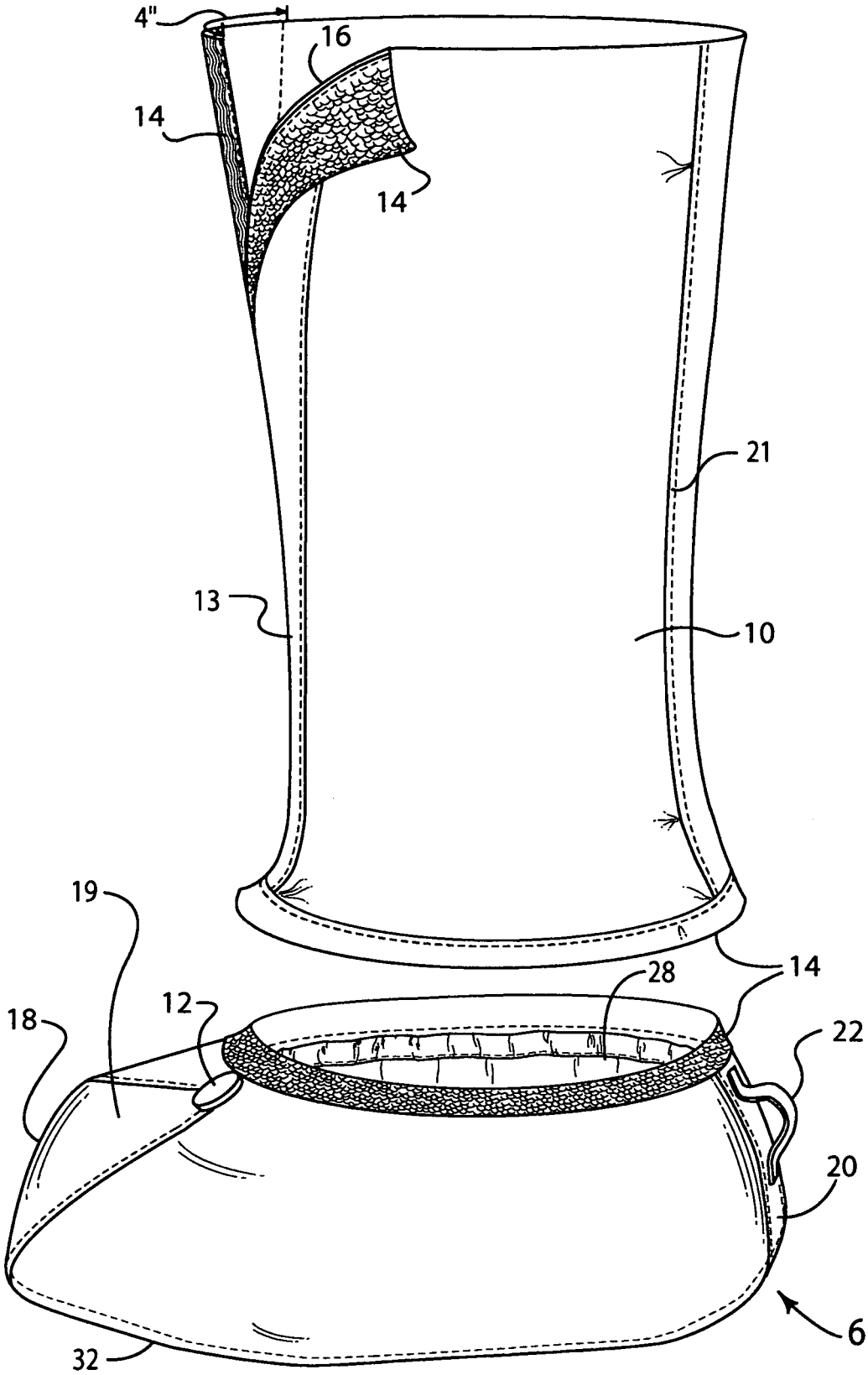
FIG. 6 a side perspective view of a bootie with a removable legging portion and Velcro(™) fasteners.
Figure 7:
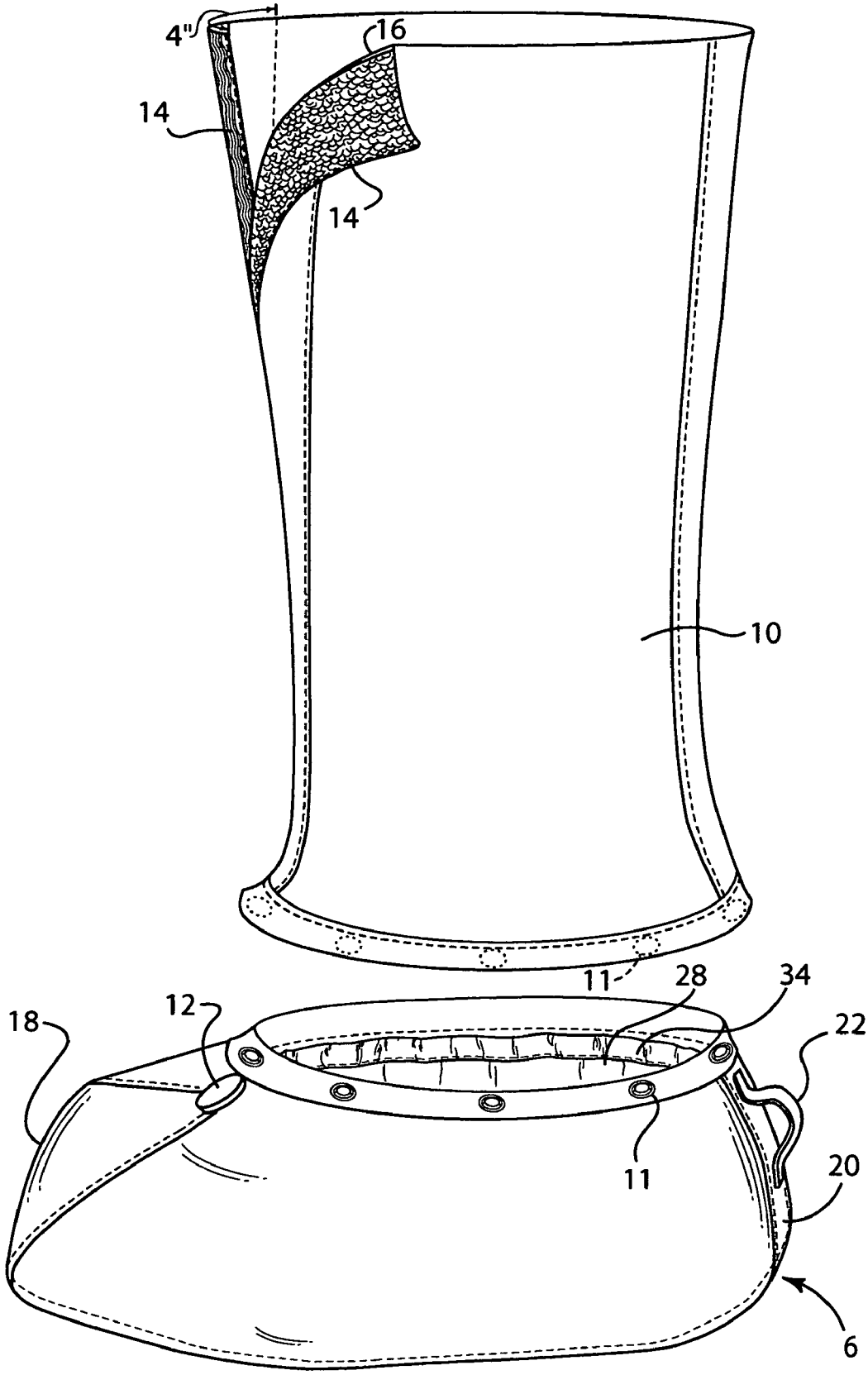
FIG. 7 is the bootie of FIG. 6 with snap fasteners.
Figure 8:
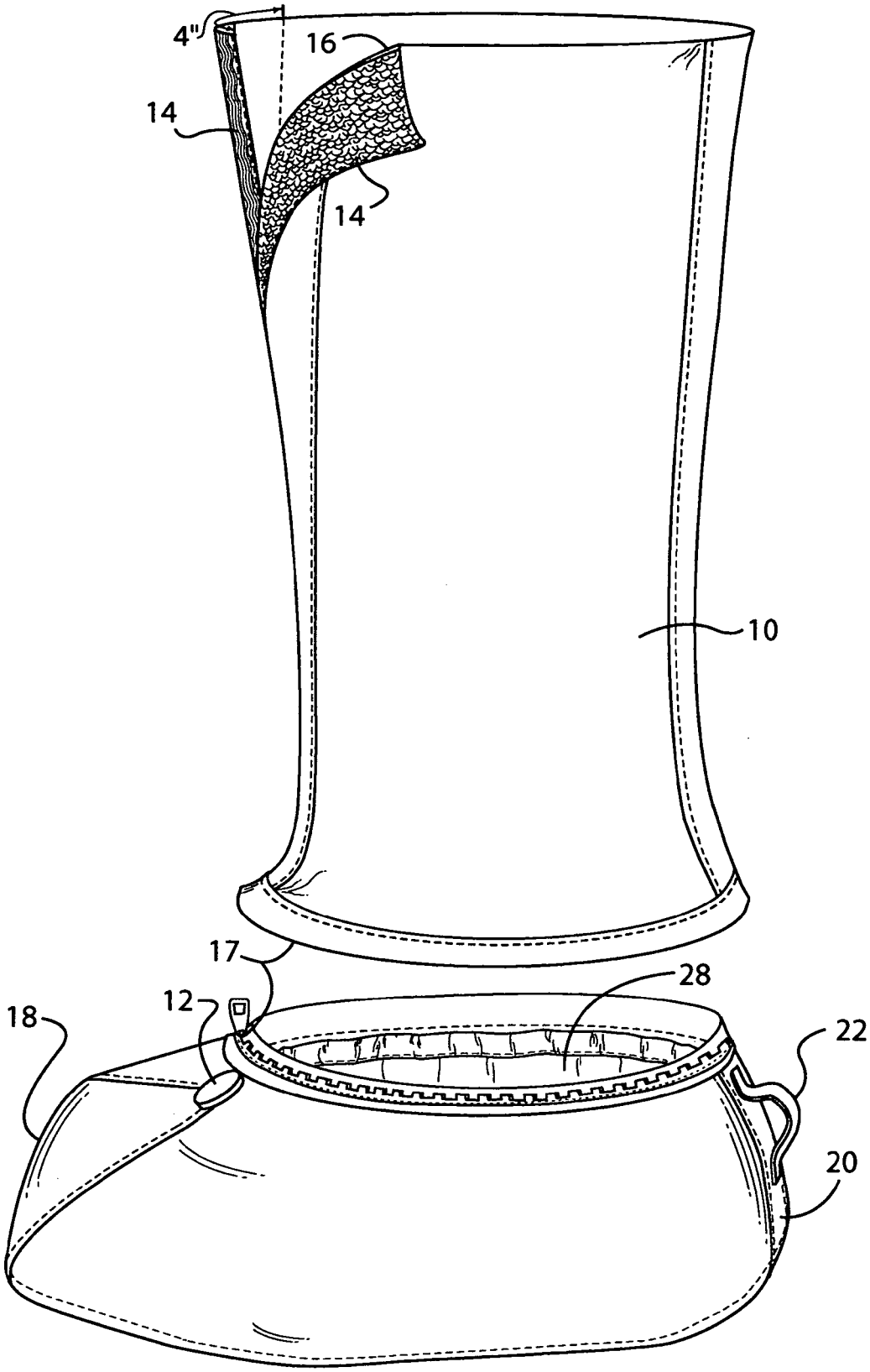
FIG. 8 is the bootie of FIG. 6 with a zipper fastener.

FIG. 3 illustrates the opening of inner legging 16 and outer legging 10, with inner surface 28 of inner bootie 26 visible. Closure device 14 has been separated from the front edges of inner legging 16. As shown, closure device 14 represents a hook-and-loop fabric combination such as Velcro(™), but a variety of closure devices could be used, including snaps, hooks and eyes, zippers or even strips of mutually attractive magnetic tape. Preferably, closure devices are used which facilitate quick and easy closing and opening of the uppers or leggings in an overlapping manner (forming closure 13) to make the booties also quick and easy to don and remove. Such alternative fasteners are illustrated in FIGS. 6–8. Strips of flexible magnetic tape (not shown here, since the Velcro™ strips are representative) could be installed in the same manner as the hook-and-loop fabric combinations 14 of FIG. 3. The edges 15 of the inner legging are visible.

Figure 4:
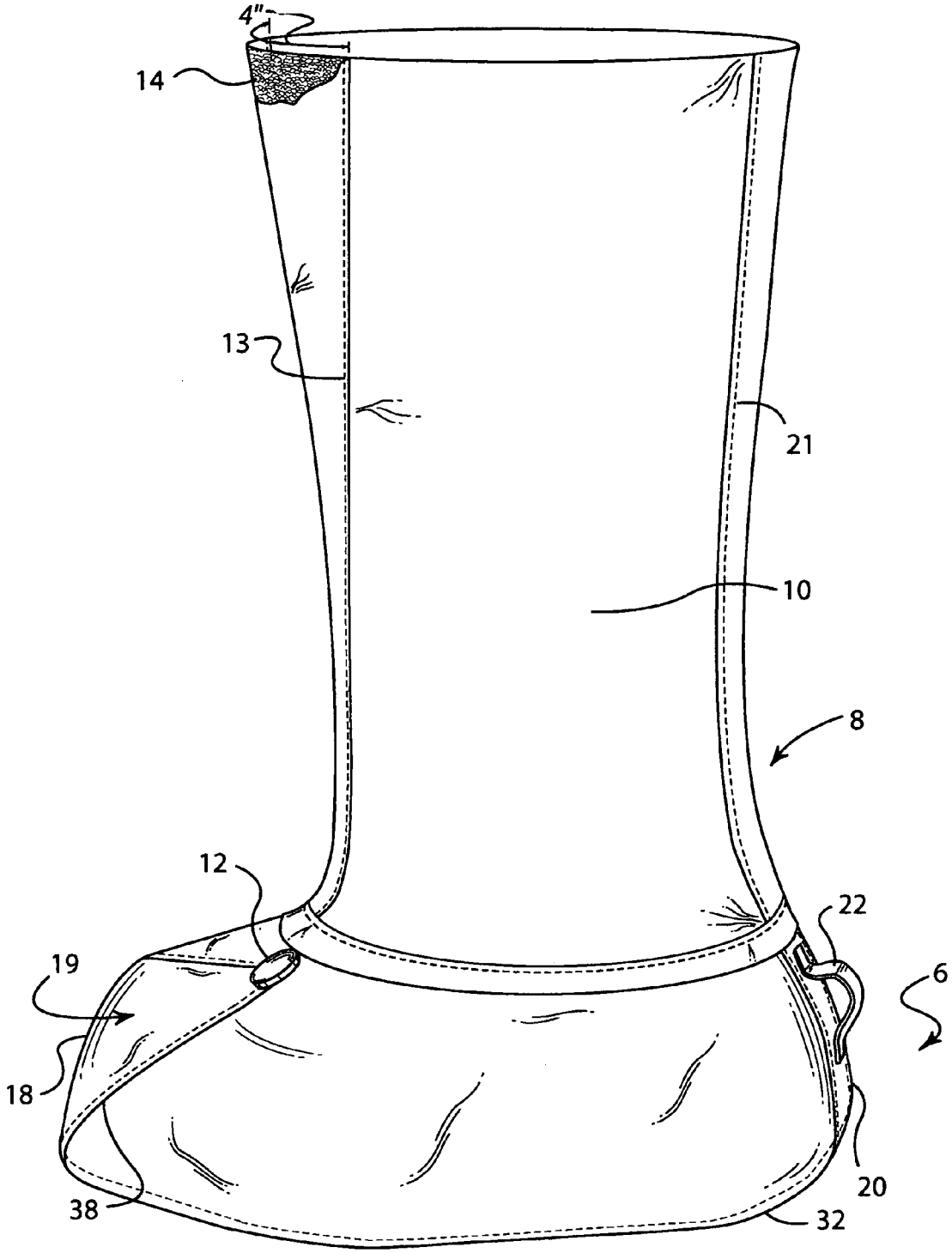
FIG. 4 is a side view of a bootie with legging attached.
Figure 5:
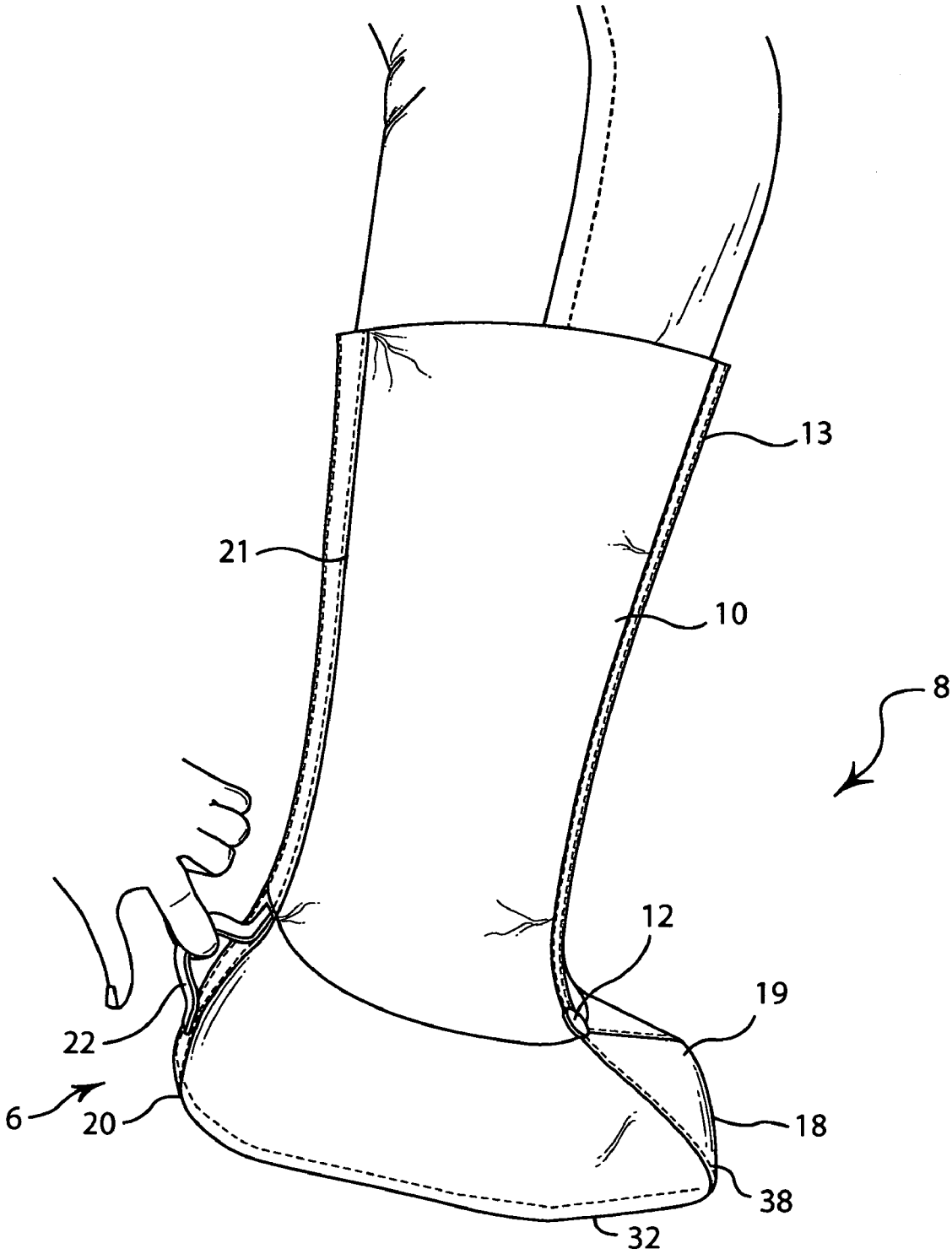
FIG. 5 is a side perspective view illustrating a method of donning the bootie of FIG. 4.

FIGS. 4 and 5 illustrate a bootie model 8 with leggings 10 of approximately knee length and a finger loop 22 attached to heel 20 to facilitate pulling the bootie onto the foot, as seen in FIG. 5. Velcro(™) strips 14 cover about three to five inches of the inner and outer surfaces of legging 10 at the top, narrowing to one inch or less where the legging 10 meets foot portion 6 of bootie 8. This facilitates quick fastening in an overlapping fashion to form closure 13 and fit the individual wearer's leg snugly. Rear closure 21 is visible.

FIGS. 6 to 8 illustrate a bootie 6 with detachable legging 10. Legging 10 is removably attachable to bootie 6 by a suitable closure device such as a hook-and-loop fabric combinations 14 (FIG. 6), Snap sets 11 (FIG. 7) or zipper 17 (FIG. 8). The upper portion of legging 10 is partially open, revealing the inner surface 16 of legging 10 and front closure means 14. The front portions of legging 10 overlap so that closure means 14 form front closure 13.

A variety of material can be used to fabricate the booties and leggings, depending upon intended use and economics. Commercially available mechanical fasteners and devices including zippers, snaps, hook and eye combinations as well as hook-and-loop fabric combinations such as Velcro(™) or other suitable devices can be used. Other mechanical fasteners such as rivets (preferably of copper, aluminum or alloys thereof) can be used to provide strength at stress points. The sheet stock can be a variety of fabrics, woven or nonwoven, such as canvas, denim or other fabrics with some degree of stiffness and resistance to wear. A 10 ounce No. 12 Duck canvas has been found to be generally suitable. The material can be obtained in natural canvas color or dyed. Heavy duty thread such as about a No. 69 nylon thread should be used in sewing the booties and leggings. The tensioning band for the bootie ankle can be of elastic about one half to 1½ inches wide, preferably about ¾ inch wide. Alternatively, heavy duty rubber bands or lengths of narrow metal or plastic coil springs can be used When assembly of the bootie is complete, it is dipped into a rubbery liquid material which at least partially impregnates the fabric and dries into a flexible, waterproof surface to protect the sole and lower portion of the bootie from moisture and other environmental hazards. The resultant coating should preferably be skid-resistant and electrically insulative. A variety of natural or synthetic rubber-based solutions or emulsions can be used, preferably of the quick-drying variety to speed up production. However, in areas where volatile organic content (VOC) limitations apply and effective ventilation is not available, aqueous emulsions or latexes may be preferable. Such materials are available commercially as Performix(™), from PLASTIDIP(™) and SANI-TRED "Permaflex-AL" (™) from Ideal Products LLC. Other suitable materials, available from Liquid Rubber Industries, Inc. Of Mississauga, Ontario, Canada, include the High-Build liquid rubber membrane system (an aqueous system), "Spray Grade" liquid rubber membrane system (an elastomeric liquid rubber emulsion) and "Non-Skid," a multi-polymer modified emulsion. A number of liquid rubber compounds are offered under stock numbers in the PMC-700 and -800 series by Nicholas J. Sarra of Clifton Park, N.Y. Smooth-Sil(™) silicone rubbers, the "Reoflex" and Evergreen series of liquid rubber compounds and "BRUSH-ON 50" mold compounds are available from the same source. EPDM Coatings LLC of West Lawn, Pa. offers "Liquid Roof" and "Liquid Rubber" products which are based upon EPDM chemistry and catalyst-cured. The Wacker Group offers VINNEX(™) thermoplastic silicone polymers. Dow Corning Corp. Of Midland, Mich. offers various silicone rubbers, liquids and compounds under the Silastic(™) label. PRO GRIP Brand no slip coatings include fine synthetic grit in a liquid rubber. Finally, Clyde W. Young Consultation Services of Lander, Wyo. offers "Chem-Shield" liquid rubber coatings, incorporating synthetic rubbers in a "VOC compliant" solvent. Suitable synthetic rubbers include urethane, polysulfide, EPDM, silicone, butyl and other synthetics which are compatible with the required solvents and/or emulsifiers and dry to form coatings which meet the requirements for booties directed to particular industries.

Figure 9:
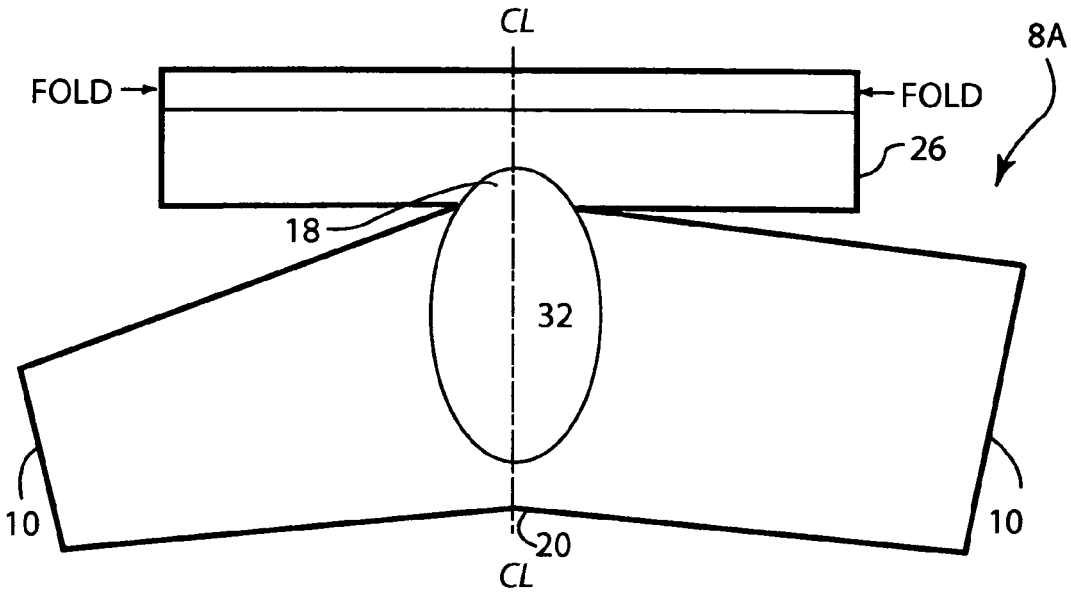
FIG. 9 is a plan view of a pattern for a bootie with attached legging.
Figure 9A:
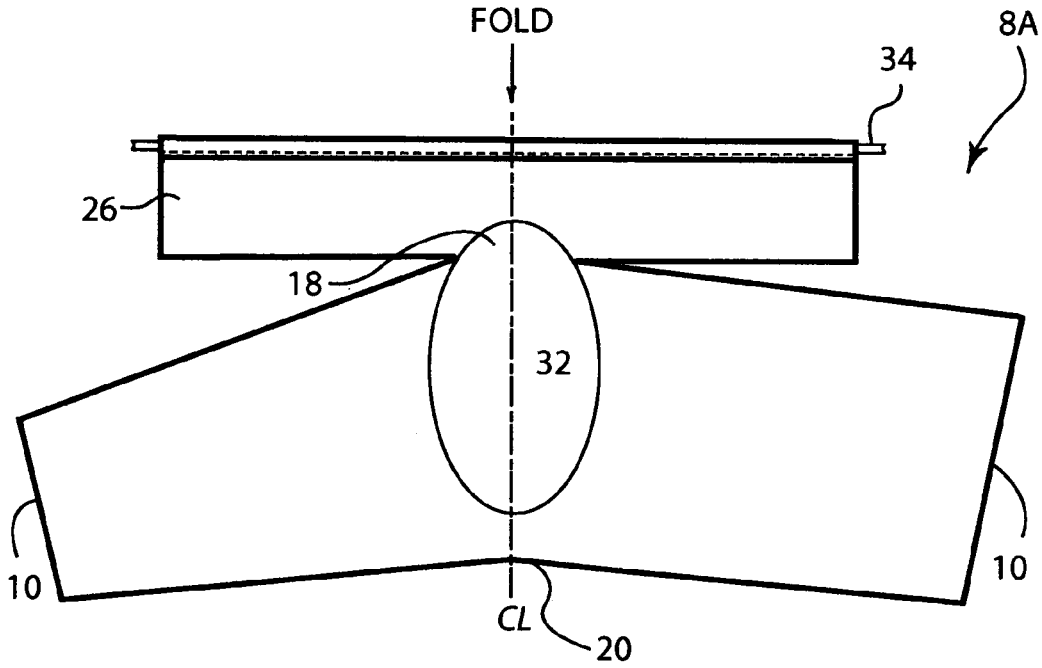
FIG. 9A is a plan view of the pattern of FIG. 9 with elastic inserted into a folded edge.
Figure 9B:
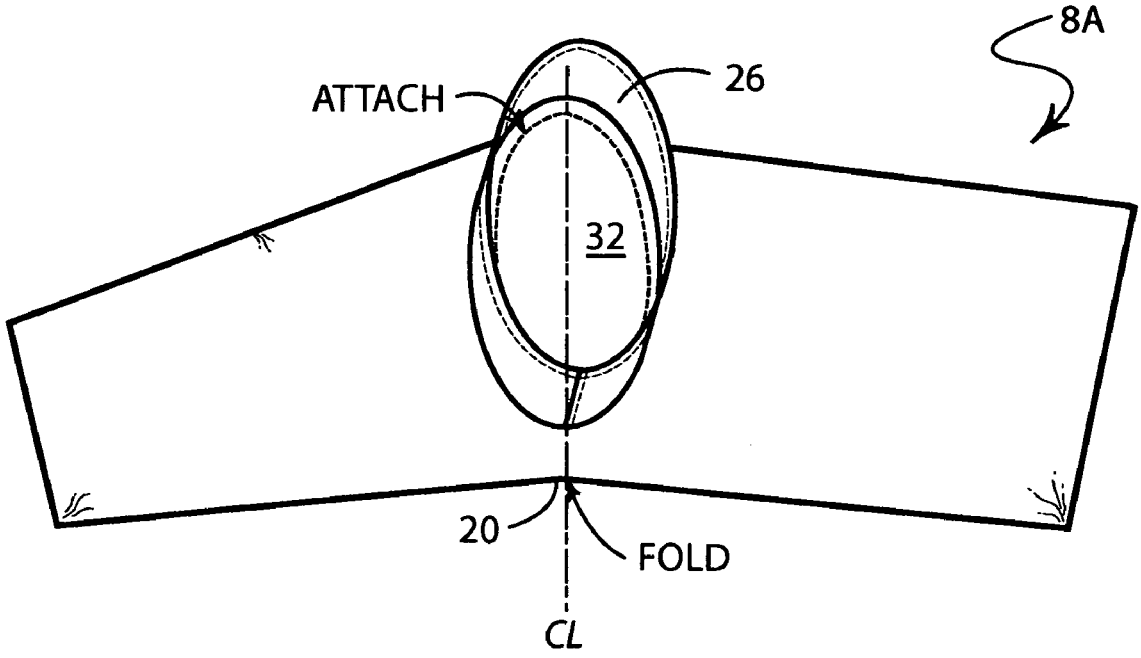
FIG. 9B is an upper perspective view of the pattern of FIG. 9A partially assembled.
Figure 9C:
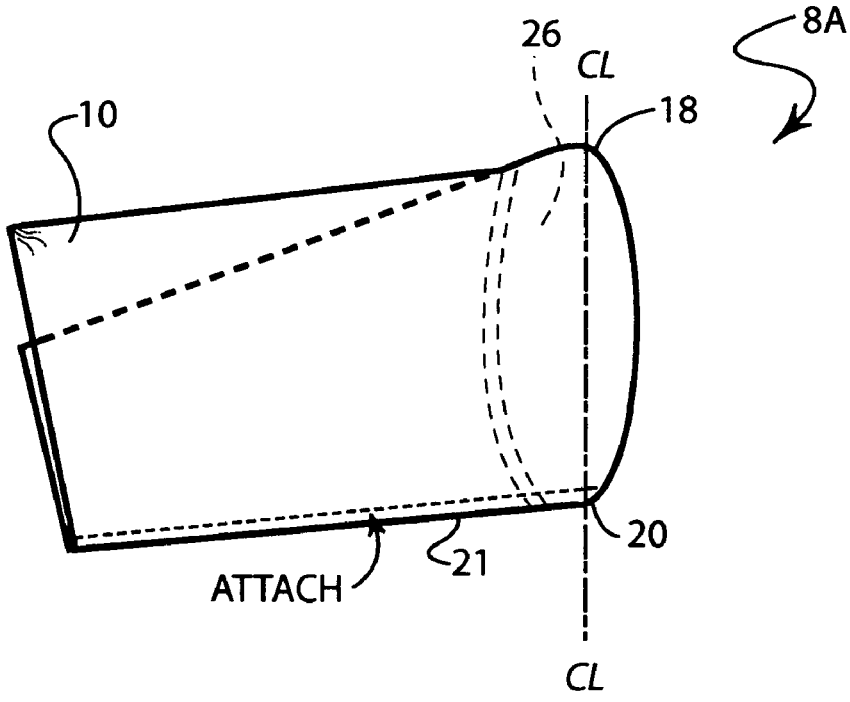
FIG. 9C is a side view of the pattern of FIG. 9B further assembled to include the upper legging.

FIGS. 9 through 9C illustrate the assembly of a basic bootie with legging 10 from cut pattern 8A. A cut pattern is a piece of suitable sheet material cut in the outline of the bootie pattern. Generally the pattern will require a rectangular piece of material about three times the length and about 4 to 5 times the width of the boot or shoe over which the bootie will be worn. All folds or double folds are folded on top of the pattern, not under the pattern. When sewing or otherwise fastening portions of the pattern together, each attached edge should be trimmed clean before proceeding to the next step. The upper portion of the inner bootie portion 26 is shown in FIG. 9A as folded over to enclose elastic 34. The heel 20 and toe 18 portions of the bootie sole 32 are shown in FIGS. 9 and 9A. FIG. 9B shows the inner bootie portion 26 bent into an oval cylindrical form to conform to sole 32 and fastened thereto by sewing or other suitable means. Then, in FIG. 9C the outer "wings" 10 of the pattern are folded about the inner bootie 26 and fastened at the rear (closure 21, adjacent heel 20) to form outer legging 10 of the bootie. The closures 14 for the front of the legging 10 can then be installed as can be seen by the figures and text above.

Figure 10:
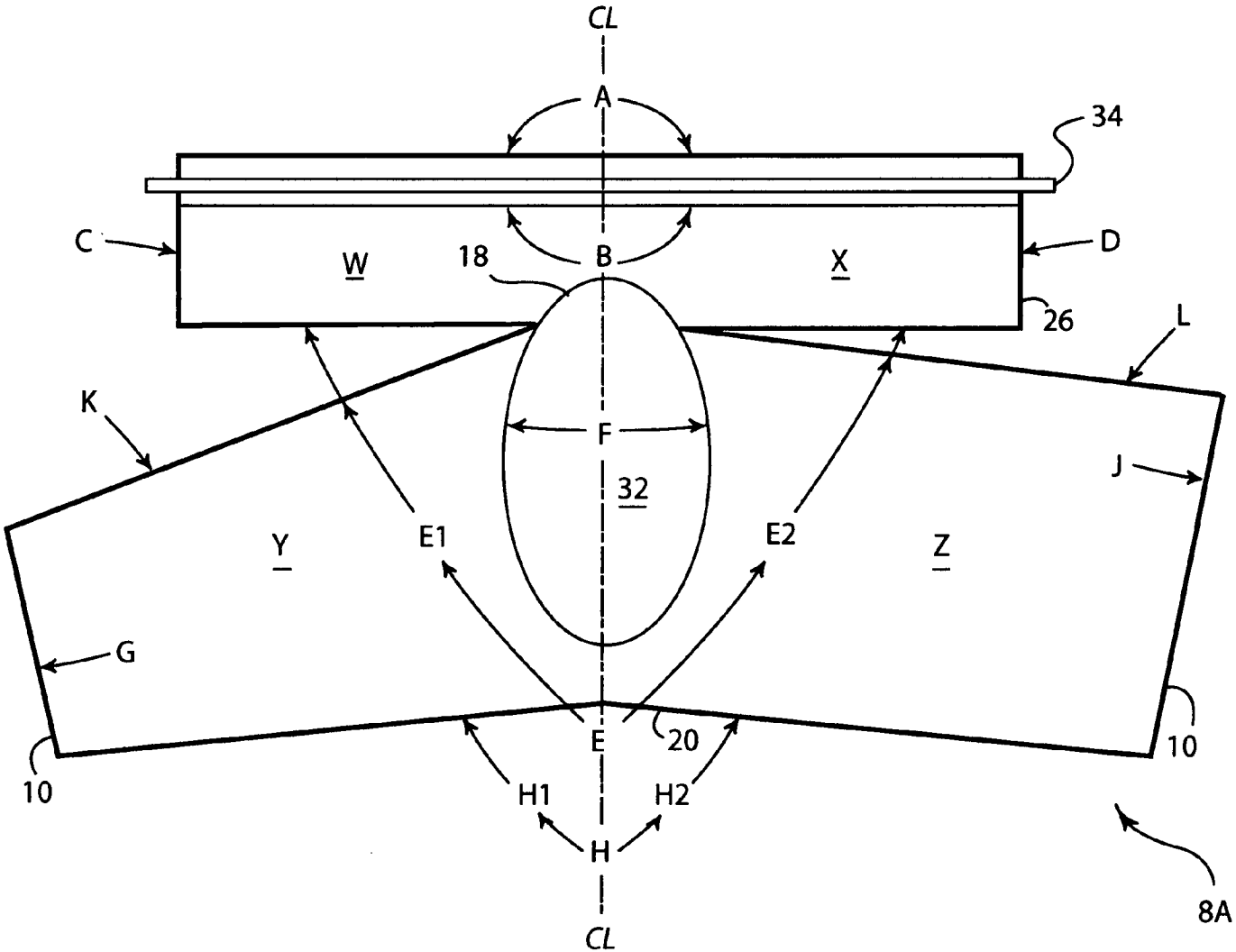
FIG. 10 is a plan view of a cut pattern for a bootie with legging, annotated to illustrate assembly procedures.

FIG. 10 provides further guidance for forming a bootie with leggings, as explained in detail below.

Materials & Equipment Needed

All material and equipment can be selected as suitable for the wearer of the booties and the expected uses. Rectangular piece of sheet material approximately three times the length and 4½ times the width of the boot or shoe that will be wearing the bootie. Attachments of suitable types for the double folds and folds of material. Also needed are longer lengths of tension devices or elastic of any suitable size or type. Metal hangers or hooked rods are needed for pulling the tensioning device through the material. Mechanical fasteners can be of any suitable size or type for the booties to be assembled Suitable cutting devices are needed for clean trimming of the attached folds of material. Optional materials and equipment include rivet(s) and rivet attaching devices such as arbor presses.

Step 1:

Fold the rectangle of sheet material such as canvas in half, making sure all edges align; then proceed to crease material down the center and press firmly until a permanent crease is confirmed.

Step 2:

Mark pattern outline on canvas. Proceed to cut or otherwise remove unneeded material to produce a flat pattern 8A for the bootie.

Step 3:

Remove piece of top layer material only, while leaving bottom material alone; this will provide for safety overlap on the front side of bootie later on in future steps.

Step 4:

FIG. 10 is the right bootie flat pattern, unfolded. When pattern 8A is unfolded, the skinny top portion WX is always the top part of the pattern. The flaps or wings Y and Z outward on the pattern are called leggings (10), and form mirror images for left and right booties. While the pattern lies in front of the worker, the large legging J should be kept to the right to form the right bootie. The cut pattern is simply flipped to form a left bootie. All steps are the same for left or right booties from this point on. The step just described is the only step that separates left and right booties.

Step 5:

Attach once; double fold and attach edge (E2) starting at the (E2-D) intersection and working inward, stopping once the end of the inner (E2-L) intersecting edge is reached.

Step 7:

Attach once; double fold and attach edge (E1), starting at the (E1-C) intersection, working inward and stopping once the end of the inner (E1-K) intersecting edge is reached.

Step 8:

Attach twice; double fold and attach edge (A) down towards (B), leaving room for the selected size of tension device. Start at the (AB-C) intersection, sewing inward towards the (AB-D) intersection and turning back around and following beside the last attached line, then working back towards the starting point and stopping at the end of the (AB-C) intersection.

Step 9:

Attach twice; double fold and attach edge (L), starting at the (LJ) corner, sewing inward towards the (E2-L) intersection and then turning back around and following beside the last attached line, stopping at the (LJ) corner.

Step 10:

Attach twice; double fold and attach edge (K), starting at the (KG) corner and sewing inward towards the (E1-K) intersection, then turning back around and following beside the last attached line and working back towards the starting point, stopping at the (KG) corner.

Step 11:

Attach once; double fold and attach edge (H2), starting at the (H2-J) corner, sewing inward and continuing once the (H1) area is reached, and stopping at the end of the (H1-G) corner.

Step 11:

Attach twice; double fold and attach edge (G), starting at the (KG) corner, sewing downward towards the (H1-G) intersection, then turning back around and following beside the last attached line and working back up towards the starting point, stopping at the (KG) corner.

Step 13:

Attach twice; double fold and attach edge (J), starting at the (LJ) corner and working downward towards the (H2-J) corner, then turning back around and following beside the last attached line and working back up towards the starting point, stopping at the (LJ) corner.

Step 14:

To provide the proper length of tensioning device, fully pull the tensioning device 34 between intersections (AB-C) and (AB-D), then cut the tensioning device to size at its fully-stretched length.

Step 15:

Bend a metal clothes hanger or other metal rod straight, providing a hook on one end. Push the resulting hooked rod through the void between edges A and B, starting at intersection (AB-D), until it reaches (AB-C) on the other side of the pattern.

Step 16:

Securely sew each intersection of (AB-C) and (AB-D). Hook the tensioning device to the hooked rod and pull the tensioning device 34 through the (AB) void, stopping once the whole tensioning device has passed through the (AB) void. Then attach (e.g., sew or staple) the last pulled through end of the tensioning device at the (AB-C) intersection only. Pull the tensioning device the rest of the way through the (AB) void until it reaches the (AB-D) intersection and attach the end of the tensioning device securely to the (AB-D) intersection, and unhook the hooked rod once the above step is completed.

Step 17:

Attach once; fold and attach edge (D) starting at the (AB-D) intersection, working downward and stopping once the end of the inner (E2-D) intersecting edge is reached.

Step 18:

Attach once; double fold and attach edge (C), starting at the (AB-C) intersection and working downward, stopping once the end of the inner (E1-C) intersection edge is reached.

Step 19:

Attach twice; pull together edges (C) and (D), putting (D) on the reverse side of (C) and making the bootie oval and centered. Attach (e.g., sew) both edges of (C) and (D) once the seam shape of the bootie appears correct, starting at the (AB-CD) intersection and working downward on the outside edge of the bootie to the end of the (E-CD) intersection and attach back up the unattached inner side of the bootie, stopping at the (AB-CD) intersection and making the back of the bootie smooth. After this step, edges (E1) and (E2) are jointly referred to as (E) only.

Step 20:

Attach twice; place the attached top portion on top of the sole 32 (F Area) of pattern 8A; center top portion WX in between the crease (centerline) on the pattern on top of the (F Area, 32) left in the first steps. Once the top and lower portions are all centered, start at the (E-K) intersection, working on staying on top of the (E) double fold and making sure that all portions stay centered. Continue sewing around the other side, turning around at the (E-L) intersection, now staying slightly on the inside of the (E) double fold, working back around and stopping once the original starting point of the (E-K) intersection is reached.

Step 21:

Attach once; fold pattern 8A on the original crease (centerline) and along back ridges (H1-H2) of the bootie; then start at the resulting (H-GJ) intersection and sew downward, staying on the outside edge and stopping once the bottom heel part 20 of (H1 and H2) is reached. After this step, (H1) and (H2) are jointly referred to as (H) only.

Step 22:

Attach twice; fold edge (H) to the inside of legging (Y), making the backing of edge (H) smooth and flush. Then start attaching at the (GJ-H) intersection, working downward to the lower heel 20 of the bootie, making sure all portions stay aligned correctly and are only being attached to legging (Y) to form a seam. Then attach and turn back up towards the starting point once the heel is reached, stopping once the (GJ-H) intersection is reached.

Step 23:

Attach twice; align (CD)'s back edge to (H)'s back edge to secure the inner bootie, making the whole bootie uniform. Start attaching at the lower (CD) and (H) back edges, working up to only the (H) backing, then turning back around and working downward to the lower heel of the bootie and stopping at the lower (CD) and (H) backings. This step creates a ridged backing for the bootie while attaching the inner and outer bootie together.

Step 24:

Attach twice; Fold legging (Y) across the (W) area, crossing slightly into the (X) area. Once aligned across the (W) area, start to attach (e.g., sew) at the (K-E) intersection, working upward to the center of (A) and slightly past, turning back around there and continuing back towards the original starting point, stopping at the (K-E) starting point.

Step 25:

Attach twice; fold legging (Z) across area (X), crossing slightly into area (W) and slightly over legging (Y). Once aligned across area (X), start to attach at the (L-E) intersection, working upward to the center of (A) and slightly past, turning back around there and continuing back towards the original starting point, finally stopping at the (L-E) starting point.

Step 26:

Place one side or component of a suitable fastener (e.g., Velcro™) on the backside of area (Y) and the other side of the fastener on the inside of area (Z), the placing and type of fastener being selected for the intended wearer. Recommended areas for placing the fasteners are next to or beside the double folds on edges (K) and (L), as shown in FIG. 4.

Step 27:

Application of waterproof coating. The coating can be applied by brushing, dipping, spraying or any other suitable method, but dipping is generally preferred. For dipping the booties, a jig fitting the inside of the bootie should be prepared from stiff but pliable wire such as coat hanger material. The jig is inserted into the bootie to hold the foot portion in the proper shape and provide a handle for the operator. Then the bootie can be slowly inserted to the proper level in the liquid coating and slowly withdrawn, allowing excess coating to drip back into the coating container. Cover the bootie to desired area with a suitable protective coating; coating to at least the inner bootie height is recommended. (See coting 24 in FIG. 1.) The bootie can be allowed to dry (at least partially) and redipped at least once to achieve the desired thickness and depth of penetration into the bootie fabric.

Step 28:

Optional rivet installation. Place a rivet 12 slightly above (A), center on (K) (L) area, overlap area and secure there to form toe flap 19 as shown in FIGS. 1 to 6. Such use of rivets would give more security at the adjustable overlap area. Detailed instructions for the installation of cap rivets with an arbor press are as follow:

a) Place the cap rivet into the top attaching receiver, which is located in the upper drive of the press. It is held in position by means of a spring-loaded collar.

b) The stud is placed into the lower attaching die, which is located on the lower bar of the press. The point of the stud is pointed up towards the cap rivet so that the flat base of the stud is held against the pressing base.

c) The section(s) of material to be riveted is now placed onto the lower attaching die in the proper centering location in the tool.

d) The upper drive of the tool is now lowered to bring into contact the cap rivet with the material section(s) to be riveted to verify that the centering location is correct.

e) Once the positioning of the material is verified as correct, the operator applies attaching pressure to secure the cap rivet to the stud.

f) The upper drive of the press is then raised to the upper locking position and the finished product is removed.

This completes the construction of a bootie with legging. Similar procedures can be used with different patterns to produce a bootie with upper portions of moderate height and no "leggings" as such.

Various changes and modifications to the presently preferred embodiments of the invention will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

We claim:

1. A protective footgear comprising;

a one-piece bootie having an inner portion and an outer portion, both portions covering a foot of the wearer up to the ankle, an upper edge of the bootie containing an elastic tensioning device wrapping around the ankle to grip the ankle;

a legging extending from the upper edge of the bootie upward to a height at least approximately the wearer's knee, a back portion of the legging being permanently closed and a front portion of the legging having front edges to define a front opening with a closure means to quickly secure the edge of said legging in place after donning by the wearer; and wherein the bootie and the legging are formed from a heavy flexible fabric and impregnated with a rubbery, waterproof material.

2. The footgear of claim 1 wherein said fabric is canvas.

3. The footgear of claim 1 wherein said coating of waterproof material is formed by the application of a solution or emulsion of natural or synthetic rubbers.

4. The footgear of claim 3 wherein said coating of waterproof material is formed by the application of a solution which comprises an organic solvent and at least one synthetic rubber.

5. The footgear of claim 3 wherein said at least one synthetic rubber comprises a silicone rubber.

6. The footgear of claim 1 wherein said closure means comprise hook-and-loop fabric combinations.

7. The footgear of claim 1 wherein said closure means comprise snap sets.

8. The footgear of claim 1 wherein said closure means comprise a zipper device.

9. The footgear of claim 1 wherein said closure means comprise combinations of magnetic tape.

10. The footgear of claim 1 wherein said closure means has closure devices arranged to permit the wearer to fasten said front edges of saidegging in variable positions to fit the wearer's legs.

11. The footgear of claim 10 wherein said closure devices comprise hook-and-loop fabric combinations wherein the strips of said hook-and-loop fabric are wider at the top of said front edges of said legging than at the bottom thereof to facilitate the closure at said legging in variable positions.

12. The footgear of claim 1 wherein said legging is removably attachable to said footgear using closure devices selected from the group consisting of hook-and-loop fabric combinations, snap sets and zipper devices.

13. The footgear of claim 1, further comprising a finger loop attached to the a heel portion of the bootie.

14. The footgear of claim 1 wherein said legging is removably attachable to said footgear around substantially the complete periphery of said legging, using closure devices selected from the group consisting of hook-and-loop fabric combinations, snap sets and zipper devices.

* * * * *